US007397201B2

(12) United States Patent
Chan

(10) Patent No.: US 7,397,201 B2
(45) Date of Patent: Jul. 8, 2008

(54) DC DIGITAL STARTING DEVICE

(76) Inventor: Cheng Ron Chan, 5F, No. 7, Alley 10, Lane 214, Yongping Rd., Yonghe City, Taipei County (TW)

( * ) Notice: Subject to any disclaimer, the term of this patent is extended or adjusted under 35 U.S.C. 154(b) by 0 days.

(21) Appl. No.: 11/520,601

(22) Filed: Sep. 14, 2006

(65) Prior Publication Data

US 2008/0067952 A1 Mar. 20, 2008

(51) Int. Cl.
*G05F 1/00* (2006.01)

(52) U.S. Cl. ..... 315/291; 315/309

(58) Field of Classification Search ..... 315/307, 315/291, 309, 311

See application file for complete search history.

(56) References Cited

U.S. PATENT DOCUMENTS 5,751,120 A * 5/1998 Zeitler et al. ..... 315/307
6,198,234 B1 * 3/2001 Henry ..... 315/291
7,061,189 B2 * 6/2006 Newman et al. ..... 315/291
7,119,494 B2 * 10/2006 Hui et al. ..... 315/219
2004/0047166 A1 * 3/2004 Lopez-Santillana et al. ... 363/89
2006/0175983 A1 * 8/2006 Crouse et al. ..... 315/291

* cited by examiner

*Primary Examiner*—Douglas W. Owens
*Assistant Examiner*—Minh Dieu A
(74) *Attorney, Agent, or Firm*—Rosenberg, Klein & Lee

(57) ABSTRACT

A DC digital starting device includes a voltage-increasing circuit, a first feedback control circuit, a frequency-varying circuit, and a second feedback control circuit. The voltage-increasing circuit provides a voltage for a load in a starting state and a normal working state. The first feedback control circuit detects voltage signals of the voltage-increasing circuit and the load and controls output voltage of the voltage-increasing circuit. The frequency-varying circuit is electrically connected to the voltage-increasing circuit for modulating frequency of the output voltage of the voltage-increasing circuit. The second feedback control circuit receives a voltage signal from the frequency-varying circuit and controls frequency of output voltage of the frequency-varying circuit.

5 Claims, 4 Drawing Sheets

DC DIGITAL STARTING DEVICE

BACKGROUND OF THE INVENTION

1. Field of the Invention

The present invention relates to a starting device and, more particularly, to a DC digital starting device that uses a DC power as an input power source.

2. Description of the Related Art

A conventional starter for a fluorescent lamp is filled with inert gas such as neon and includes two movable electrodes made of metal plates. Electric current causes reaction of the inert gas and generates heat to cause expansion of the metal plates. The expanded metal plates come into contact with each other and light the lamp.

The starting speed of the conventional starter largely depends on the actual starting voltage. The starting voltage is generally increased to create higher starting power to shorten the time for lighting the lamp. However, electronic elements of the starter are liable to be damaged by the high starting voltage. Further, the conventional starter does not include functions of varying voltage and frequency and, thus, cannot provide energy-saving effect, leading to a waste in resources.

SUMMARY OF THE INVENTION

A DC digital starting device in accordance with the present invention comprises a voltage-increasing circuit, a first feedback control circuit, a frequency-varying circuit, and a second feedback control circuit. The voltage-increasing circuit provides a voltage for a load in a starting state and a normal working state. The first feedback control circuit detects voltage signals of the voltage-increasing circuit and the load and controls output voltage of the voltage-increasing circuit. The frequency-varying circuit is electrically connected to the voltage-increasing circuit for modulating frequency of the output voltage of the voltage-increasing circuit. The second feedback control circuit receives a voltage signal from the frequency-varying circuit and controls frequency of output voltage of the frequency-varying circuit.

Preferably, the voltage-increasing circuit includes a DC/DC voltage-increasing circuit, a rectifying circuit, a filtering circuit, and a DC/AC conversion circuit. The DC/DC voltage-increasing circuit has an input connected to a DC power source. The rectifying circuit and the filtering circuit filter noise after voltage-increasing operation. The DC/AC conversion circuit converts a DC power source from the DC/DC voltage-increasing circuit into an AC power source.

Preferably, the voltage-increasing circuit includes a temperature-detecting circuit for detecting temperature of the voltage-increasing circuit and sending a signal regarding the temperature of the voltage-increasing circuit to a fan control circuit.

Preferably, the voltage-increasing circuit includes a low-voltage protecting circuit and a power-switching circuit. The low-voltage protecting circuit is electrically connected to the first feedback control circuit. The power-switching circuit is controlled by the voltage signal detected by the first feedback control circuit.

Preferably, the frequency-varying circuit includes a coupling circuit receiving the voltage signal from the frequency-varying circuit. The voltage signal from the frequency-varying circuit is coupled and transformed and then sent to the second feedback control circuit, allowing the second feedback control circuit to modulate and control the voltage frequency and output based on a control signal of the load.

Preferably, the frequency-varying circuit controls output of the frequency-varying circuit by pulse width modulation.

Other objectives, advantages, and features of the invention will become more apparent from the following detailed description when taken in conjunction with the accompanying drawings.

DETAILED DESCRIPTION OF THE PREFERRED EMBODIMENT

Figure 1:
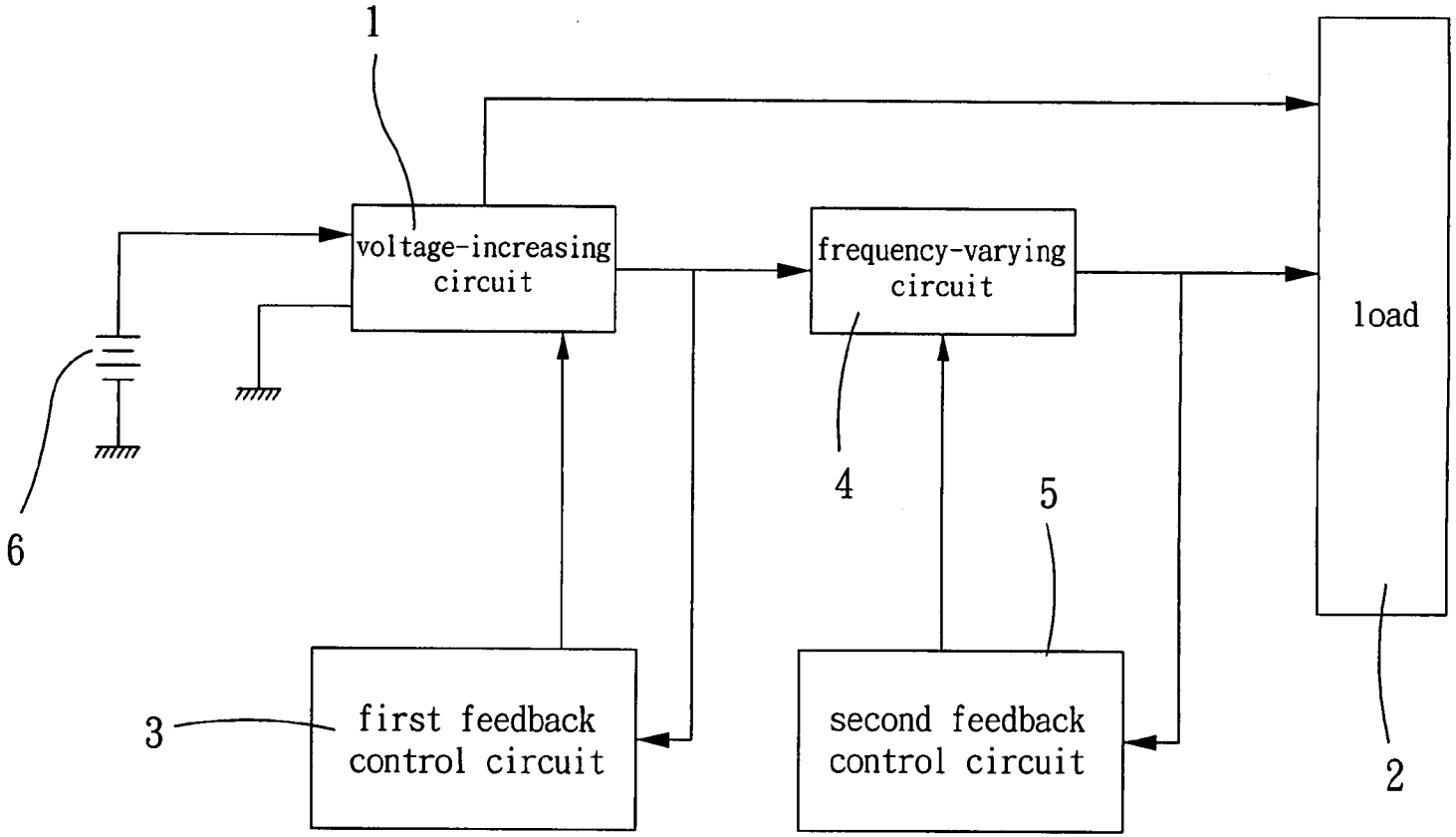
FIG. 1 is a schematic block diagram of a DC digital starting device in accordance with the present invention.

Referring to FIG. 1, a DC digital starting device in accordance with the present invention comprises a voltage-increasing circuit 1, a first feedback control circuit 3, a frequency-varying circuit 4, and a second feedback control circuit 5.

The voltage-increasing circuit 1 provides a voltage to a load 2 during starting and working. In this embodiment, the load 2 is a lamp, and the voltage-increasing circuit 1 is a DC/DC voltage-increasing circuit 11 includes an input connected to a DC power source such as a battery 6 with a voltage of 12V, 24V, 36V, etc. A working voltage of about 200-380 V is required during stable working of the lamp whereas a higher working voltage of about 500-600 V is required for starting of the lamp. Hence, the voltage-increasing circuit 1 must increase the voltage to provide the electricity required for normal working state and transient starting state of the lamp.

The first feedback control circuit 3 detects voltage signals from the voltage-increasing circuit 1 and the load 2 to control the output voltage of the voltage-increasing circuit 1. Hence, before starting the lamp, the working voltage for starting the lamp can be controlled (by controlling the output voltage of the voltage-increasing circuit 1) to be higher than that required for stable working state. After the lamp is lit, the voltage signal of the lamp can be detected to control the working voltage of the lamp, thereby achieving control of optimal power of the lamp.

The frequency-varying circuit 4 is electrically connected to the voltage-increasing circuit 1 and modulates the frequency of the output voltage of the voltage-increasing circuit 1. In this example, the output of the frequency-varying circuit 4 is controlled by pulse width modulation (PWM).

The second feedback control circuit 5 receives the voltage signal from the frequency-varying circuit 4 and controls the frequency of output voltage of the frequency-varying circuit 4. For example, when the load 2 is decreased, the pulse width of the frequency-varying circuit 4 becomes narrow which results in a voltage drop in the frequency-varying circuit 4, thereby triggering frequency-varying operation of the frequency-varying circuit 4. Hence, the frequency-varying circuit 4 is capable of outputting proper pulse width based on the magnitude of the load 2 and, thus, able to change the output working frequency, providing an energy-saving effect.

Figure 2:
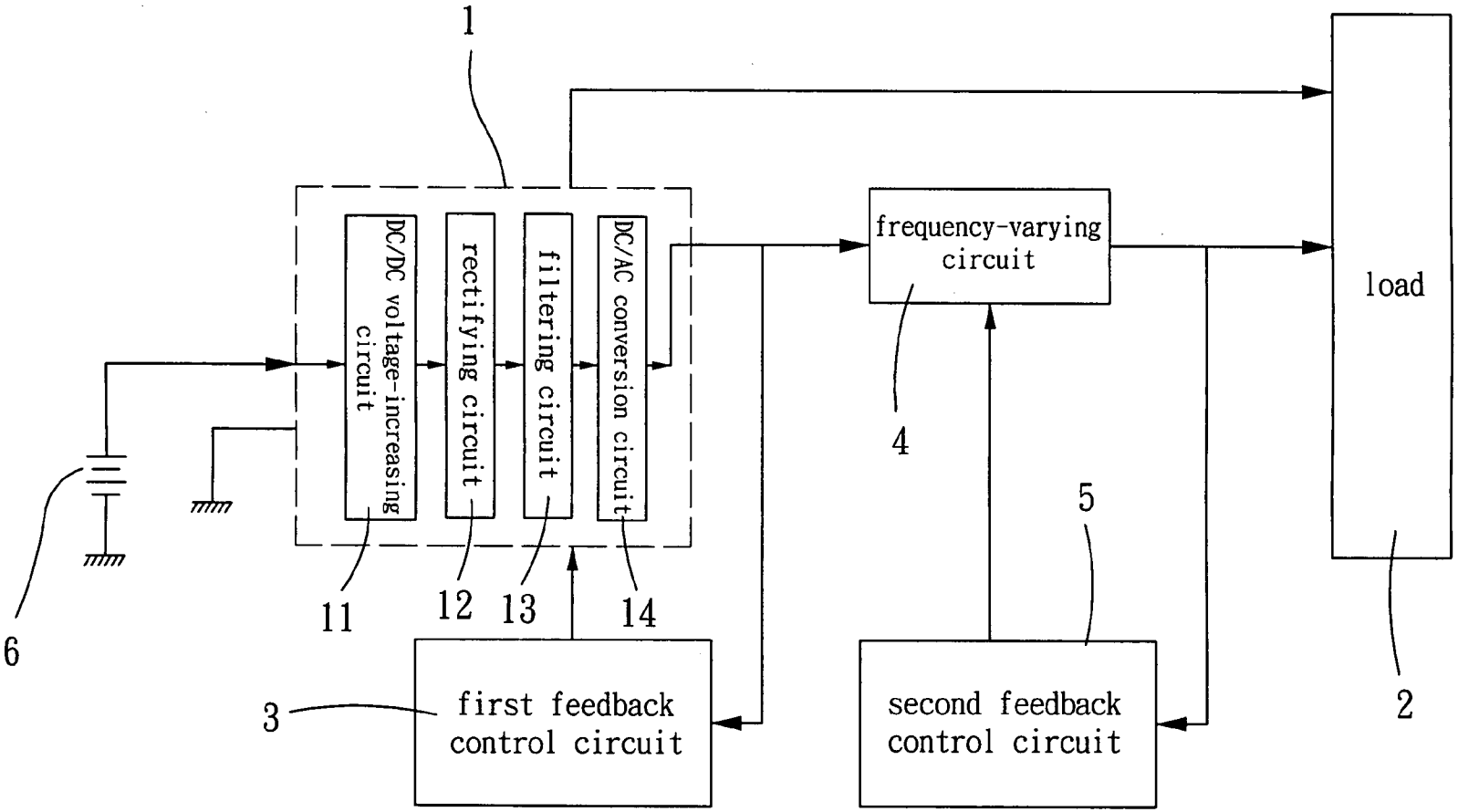
FIG. 2 is a block diagram similar to FIG. 1, illustrating detailed structure of a voltage-increasing circuit of the DC digital starting device in accordance with the present invention.

Referring to FIG. 2, the voltage-increasing circuit 1 includes a DC/DC voltage-increasing circuit 11, a rectifying circuit 12, a filtering circuit 13, and a DC/AC conversion circuit 14. An input of the DC/DC voltage-increasing circuit 11 is connected to a DC power source 6. The rectifying circuit 12 and the filtering circuit 13 filter noise signals after the voltage-increasing operation. The DC/AC conversion circuit 14 converts the DC power source 6 input to the DC/DC voltage-increasing circuit 11 into an AC power source for frequency-varying operation of the frequency-varying circuit 4.

Figure 3:
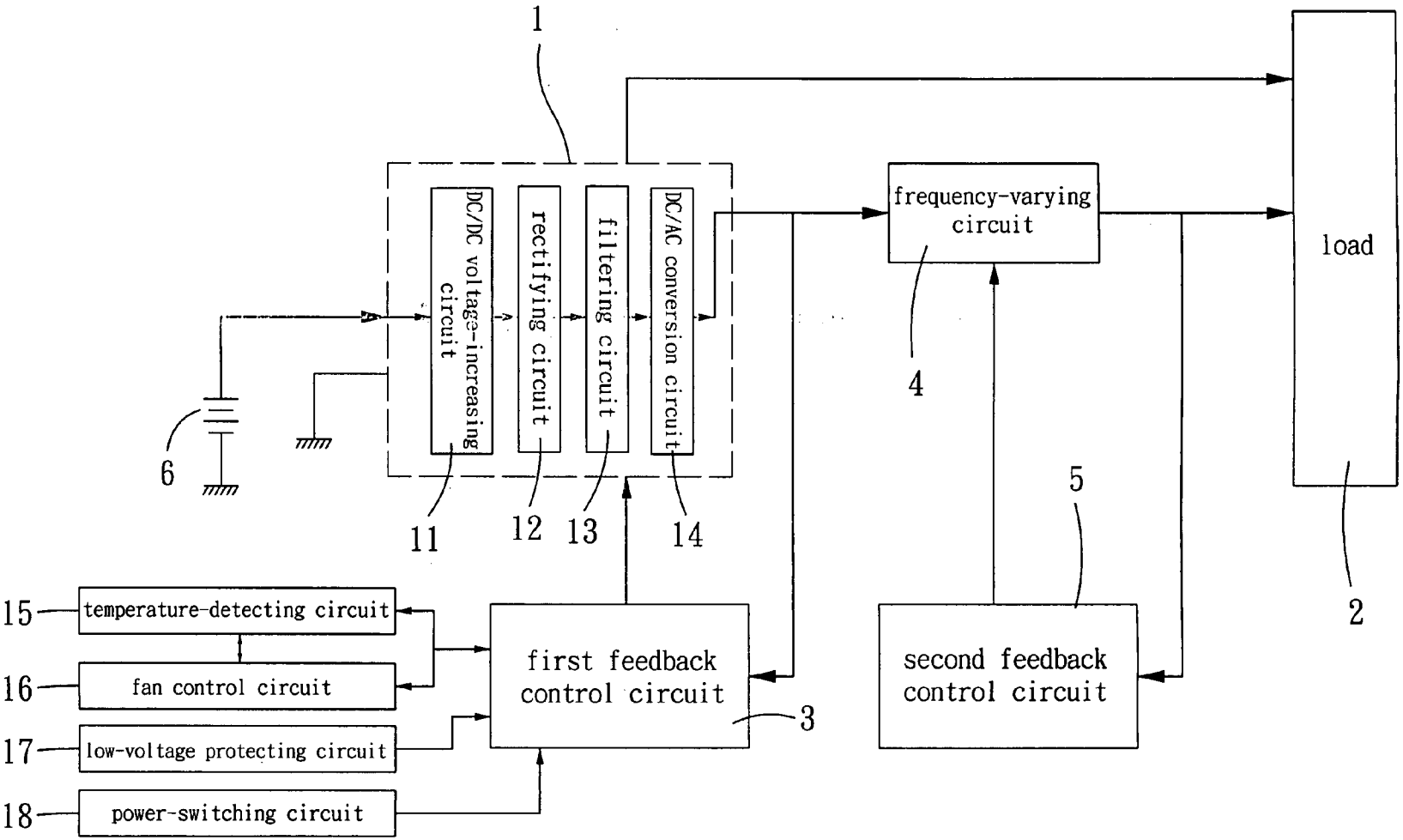
FIG. 3 is a block diagram similar to FIG. 2, illustrating detailed structure of a first feedback control circuit of the DC digital starting device in accordance with the present invention.

Referring to FIG. 3, the voltage-increasing circuit 1 includes a temperature-detecting circuit 15 for detecting the temperature of the voltage-increasing circuit 1 and sends a signal regarding the temperature of the voltage-increasing circuit 1 to a fan control circuit 16. In a case that the temperature reaches a first preset value (such as 45° C.), the voltage-increasing circuit 1 outputs electricity to and turns on an external fan (not shown). Operation of the fan stops when the temperature of the voltage-increasing circuit 1 drops to a second preset value lower than the first preset value.

Referring to FIG. 3, the voltage-increasing circuit 1 further includes a low-voltage protecting circuit 17 and a power-switching circuit 18. The low-voltage protecting circuit 17 is connected to the first feedback control circuit 3. The output voltage of the voltage-increasing circuit 1 can be obtained by the voltage signal detected by the first feedback control circuit 3. In a case that the output voltage of the voltage-increasing circuit 1 is low, the power-switching circuit 18 switches to form an open circuit to avoid damage to the electronic elements of the voltage-increasing circuit 1. For example, in a case that the DC voltage of the battery 6 lowers to 10.5 V due to the load, an LED is turned on to provide an alarm effect. When the voltage of the battery 6 lowers to 10V, the low-voltage protecting circuit 17 is activated to form an open circuit and to cut off the load to the voltage-increasing circuit 1. Damage to the battery 6 (i.e., the DC power source) is avoided, and the life of the battery 6 is prolonged accordingly.

Figure 4:
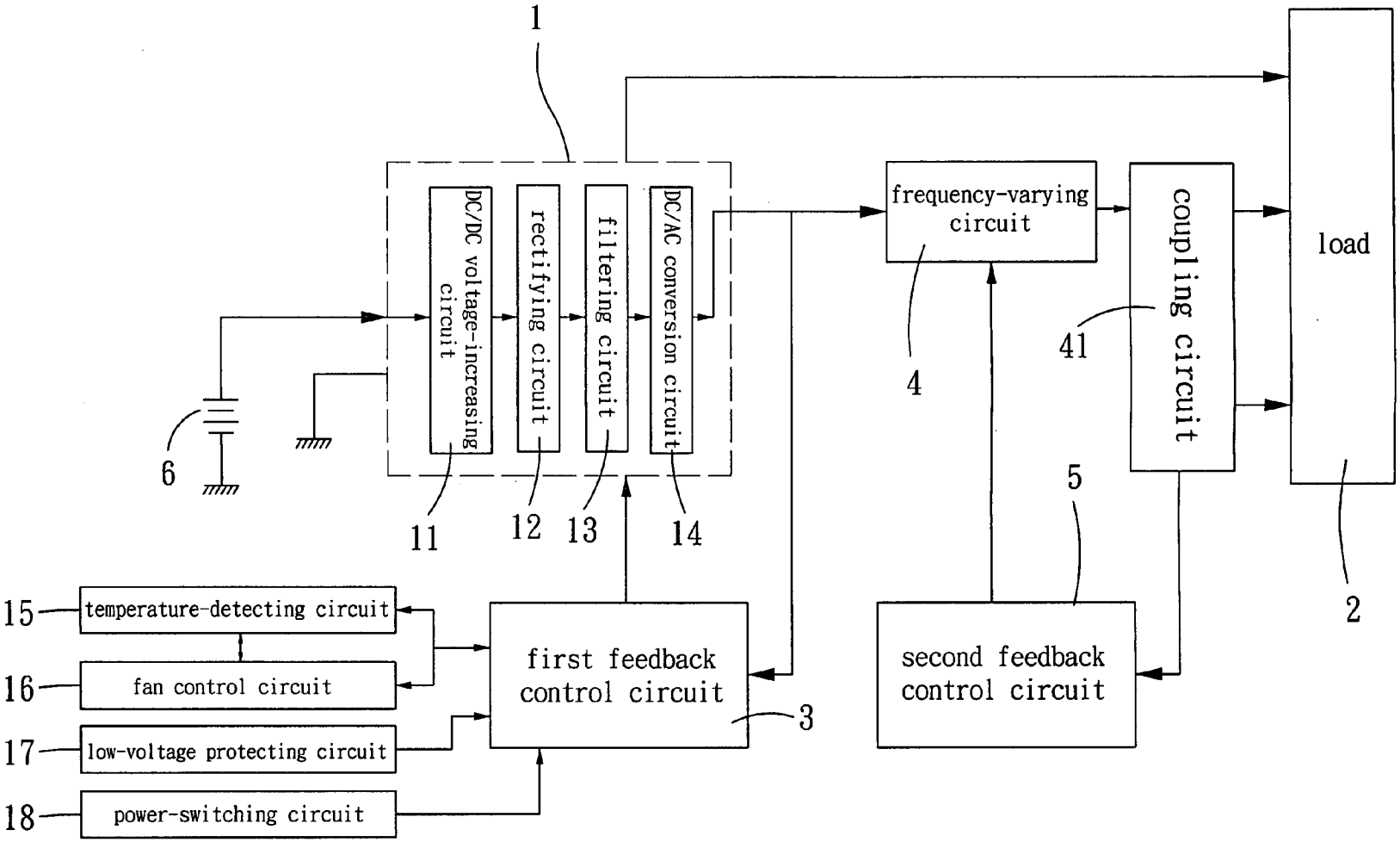
FIG. 4 is a block diagram similar to FIG. 3, illustrating detailed structure of a frequency-varying circuit of the DC digital starting device in accordance with the present invention.

Referring to FIG. 4, the frequency-varying circuit 4 includes a coupling circuit 41 that receives the output voltage signal from the frequency-varying circuit 4. The output voltage signal from the frequency-varying circuit 4 is coupled and transformed and then sent to the second feedback control circuit 5 such that the second feedback control circuit 5 can modulate and control the voltage frequency and proper output based on the control signal of the load.

As apparent from the foregoing, the output power and working frequency can be modulated and controlled based on the transient starting state and the stable working state of the load, thereby obtaining optimal output power, saving electricity, and avoiding damage to the electronic elements.

The DC digital starting device can be used for various lights and lamps (such as road lamps, fluorescent lamps, indoor lights, illuminating lights for factories, emergency lights, etc.) as well as various devices.

Although a specific embodiment has been illustrated and described, numerous modifications and variations are still possible. The scope of the invention is limited by the accompanying claims.

What is claimed is:

1. A DC digital starting device comprising:

a voltage-increasing circuit providing a voltage for a load in a starting state and a normal working state, said voltage-increasing circuit including a temperature-detecting circuit for detecting temperature of the voltage-increasing circuit and sending a signal regarding the temperature of the voltage-increasing circuit to a fan control circuit;

a first feedback control circuit detecting voltage signals of the voltage-increasing circuit and the load and controlling output voltage of the voltage-increasing circuit;

a frequency-varying circuit electrically connected to the voltage-increasing circuit for modulating frequency of the output voltage of the voltage-increasing circuit; and a second feedback control circuit receiving a voltage signal from the frequency-varying circuit and controlling frequency of output voltage of the frequency-varying circuit.

2. The DC digital starting device as claimed in claim 1 wherein the voltage-increasing circuit includes a DC/DC voltage-increasing circuit, a rectifying circuit, a filtering circuit, and a DC/AC conversion circuit, the DC/DC voltage-increasing circuit having an input connected to a DC power source, the rectifying circuit and the filtering circuit filtering noise after voltage-increasing operation, the DC/AC conversion circuit converting a DC power source from the DC/DC voltage-increasing circuit into an AC power source.

3. The DC digital starting device as claimed in claim 1 wherein the voltage-increasing circuit includes a low-voltage protecting circuit and a power-switching circuit, the low-voltage protecting circuit being electrically connected to the first feedback control circuit, the power-switching circuit being controlled by the voltage signal detected by the first feedback control circuit.

4. The DC digital starting device as claimed in claim 1 wherein the frequency-varying circuit includes a coupling circuit receiving the voltage signal from the frequency-varying circuit, the voltage signal from the frequency-varying circuit being coupled and transformed and then sent to the second feedback control circuit, allowing the second feedback control circuit to modulate and control the voltage frequency and output based on a control signal of the load.

5. The DC digital starting device as claimed in claim 1 wherein the frequency-varying circuit controls output of the frequency-varying circuit by pulse width modulation.

* * * * *